US005796372A

United States Patent [19]

Elliot

[11] Patent Number: 5,796,372

[45] **Date of Patent: *Aug. 18, 1998**

[54] FOLDED CROSS GRID DIPOLE ANTENNA

[75] Inventor: Paul G. Elliot, Vienna, Va.

[73] Assignee: APTI Inc., Washington, D.C.

[ * ] Notice: The term of this patent shall not extend beyond the expiration date of Pat. No. 5,923,176.

[21] Appl. No.: 683,238

[22] Filed: Jul. 18, 1996

[51] Int. Cl.[6] ..... H01Q 21/26

[52] U.S. Cl. ..... 343/797; 343/807

[58] Field of Search ..... 343/795, 797, 343/798, 803, 815, 818; H01Q 21/26

[56] References Cited

U.S. PATENT DOCUMENTS

| | | | |
|---|---|---|---|
| 3,196,443 | 7/1965 | Martin | 343/797 |
| 3,273,158 | 9/1966 | Fouts et al. | 343/797 |
| 4,922,263 | 5/1990 | Dubost et al. | 343/797 |
| 5,075,691 | 12/1991 | Garay et al. | 343/797 |
| 5,280,297 | 1/1994 | Profera, Jr. | 343/797 |
| 5,293,176 | 3/1994 | Elliot | 343/797 |
| 5,521,610 | 5/1996 | Rodal | 343/797 |

*Primary Examiner*—Donald T. Hajec
*Assistant Examiner*—Tan Ho
*Attorney, Agent, or Firm*—Rossi & Associates

[57] ABSTRACT

A folded crossed grid dipole antenna element includes one or more partially or fully conductive areas in the antenna element. The conductive areas are defined by a group of conductors of the antenna element. In a further configuration, upper and lower tiers of a conventional antenna element are essentially switched and a transmission feed line is provided to the upper tier via an opening in the lower tier.

18 Claims, 4 Drawing Sheets

FOLDED CROSS GRID DIPOLE ANTENNA

FIELD OF THE INVENTION

The invention relates in general to antenna elements. More specifically, the invention relates to antenna elements that provide arbitrary polarization and can be used to form a scanning array with a minimum number of elements while maintaining relatively constant active element input impedance over bandwidths approaching one octave.

BACKGROUND

Crossed dipole (or turnstile antennas), folded dipoles and wire biconical antennas have been used alone and in arrays in a variety of communications and radar applications. Biconical antennas have broadband characteristics that are useful in the VHF and UHF frequency ranges, but the size of the solid shell biconical structure limits many practical applications. As a compromise, multi-element intersecting wire bow tie antennas have been employed to approximate biconical antennas.

U.S. Pat. No. 5,293,176, the contents of which are incorporated herein by reference, discloses a folded cross grid dipole antenna element that attempts to combine the desirable features of biconical, crossed dipole and folded dipole antenna elements. It is an object of the invention to provide improvements to the folded crossed grid dipole antenna element disclosed in U.S. Pat. No. 5,293,176.

SUMMARY OF THE INVENTION

The invention provides improvements in folded cross grid dipole antenna elements by incorporating one or more partially or fully conductive areas in the antenna element. A further improvement is provided by essentially reversing the upper and lower tiers of the conventional antenna element and providing a transmission feed line to the upper tier via an opening in the lower tier.

More specifically, an antenna element is provided that includes a ground plane, a first crossed grid dipole including a plurality of perimeter conductors, where the first crossed grid dipole is arranged in an X-Y plane corresponding to a first tier and includes an interconnected plurality of arms, and a second crossed grid dipole including a plurality of perimeter conductors, where the second crossed grid dipole is arranged in an X-Y plane corresponding to a second tier and includes a plurality of non-interconnected arms. Each of the non-interconnected arms of the second crossed grid dipole includes a feed input. The first tier is vertically separated from the second tier and the ground plane, and the second tier is located between the ground plane and the first tier. The first crossed grid dipole is connected to the second crossed grid dipole by vertical conductors. An area defined by at least one of a group of the perimeter conductors of the first crossed grid dipole, a group of the perimeter conductors of the second crossed grid dipole, and a group of the perimeter conductors of the first and second crossed gird dipoles and the vertical conductors, is at least partially conductive.

Still further, an antenna element is provided that includes a ground plane, a first crossed grid dipole including a plurality of perimeter conductors, where the first crossed grid dipole is arranged in an X-Y plane corresponding to a first tier and includes a plurality of non-interconnected arms, and where each of the non-interconnected arms of the first crossed grid dipole includes a feed input, and a second crossed grid dipole includes a plurality of perimeter conductors, where second crossed grid dipole is arranged in an X-Y plane corresponding to a second tier and including a plurality of interconnected arms. The first tier is vertically separated from the second tier and the ground plane, and the second tier is located between the ground plane and the first tier. The first crossed grid dipole is connected to the second crossed grid dipole by vertical conductors. Center corners of the arms of the second tier are interconnected to permit a transmission feed line to pass through the second tier and to the feed inputs of the arms of the first crossed grid dipole.

BRIEF DESCRIPTION OF THE DRAWINGS

The invention will be described in greater detail with reference the accompanying drawings, wherein.

DETAILED DESCRIPTION OF THE PREFERRED EMBODIMENTS

Figure 1:
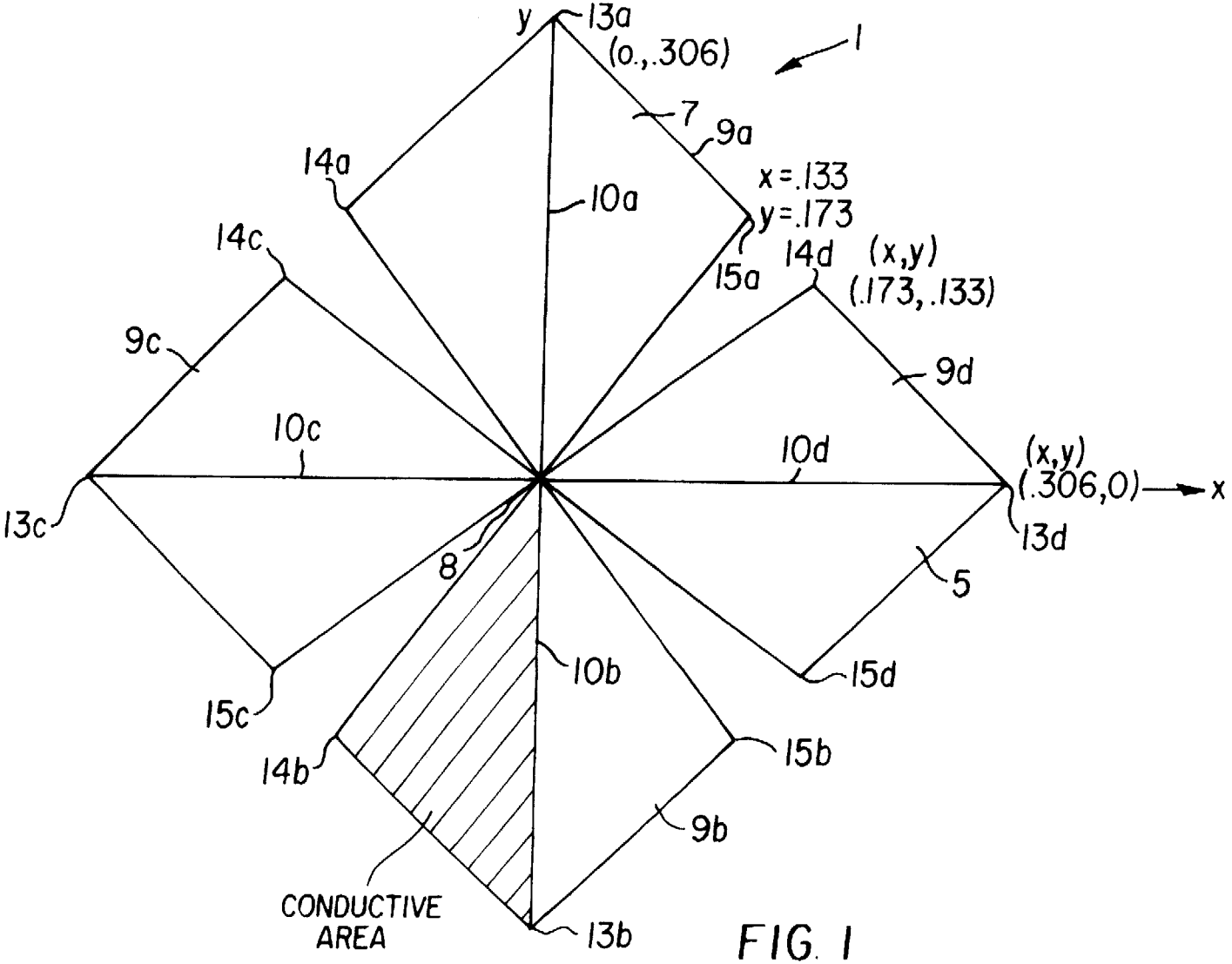
FIG. 1 is a top view of a first tier of an antenna element in accordance with a first embodiment of the invention.
Figure 2:
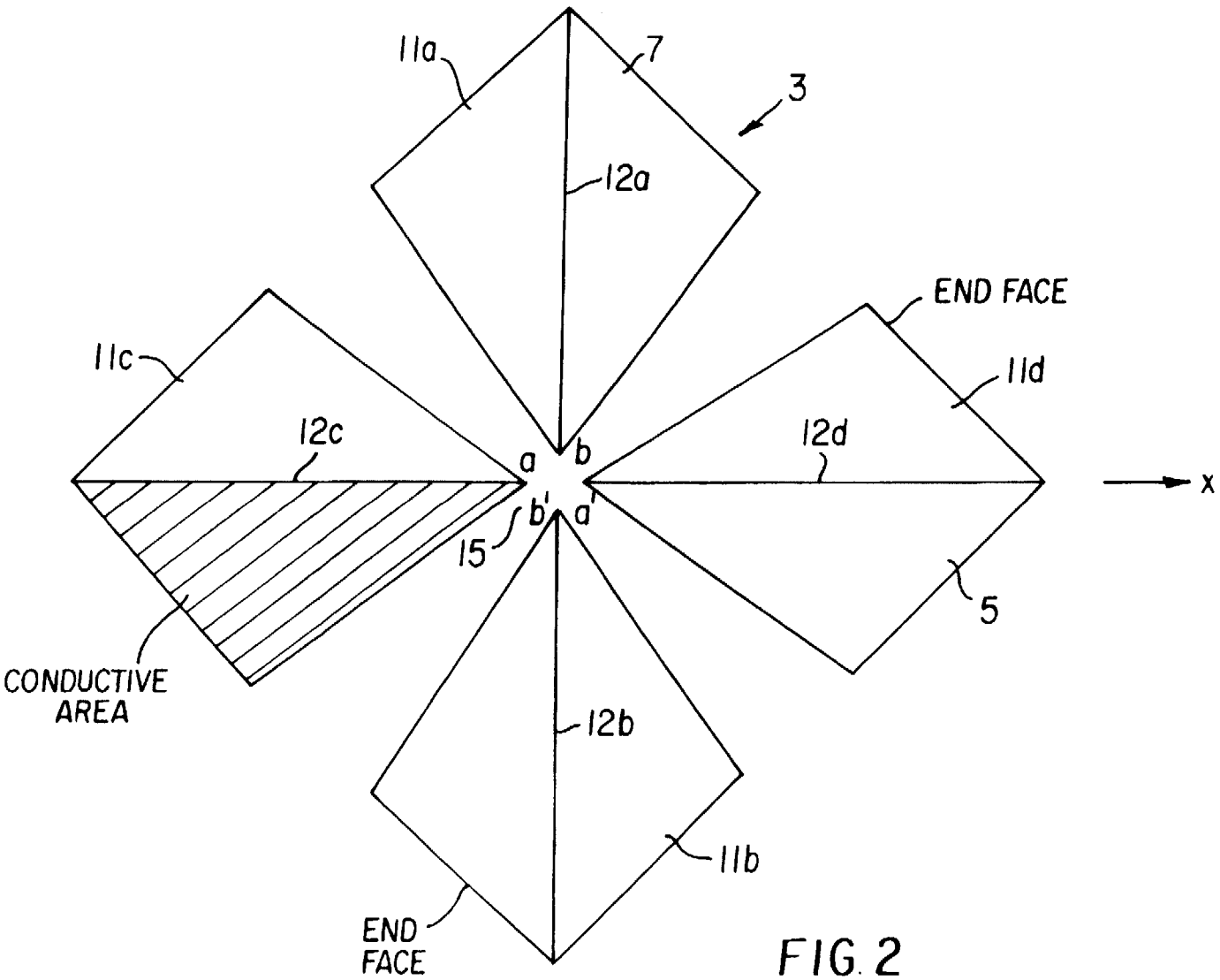
FIG. 2 is a top view of a second tier of an antenna element in accordance with a first embodiment of the invention.
Figure 3:
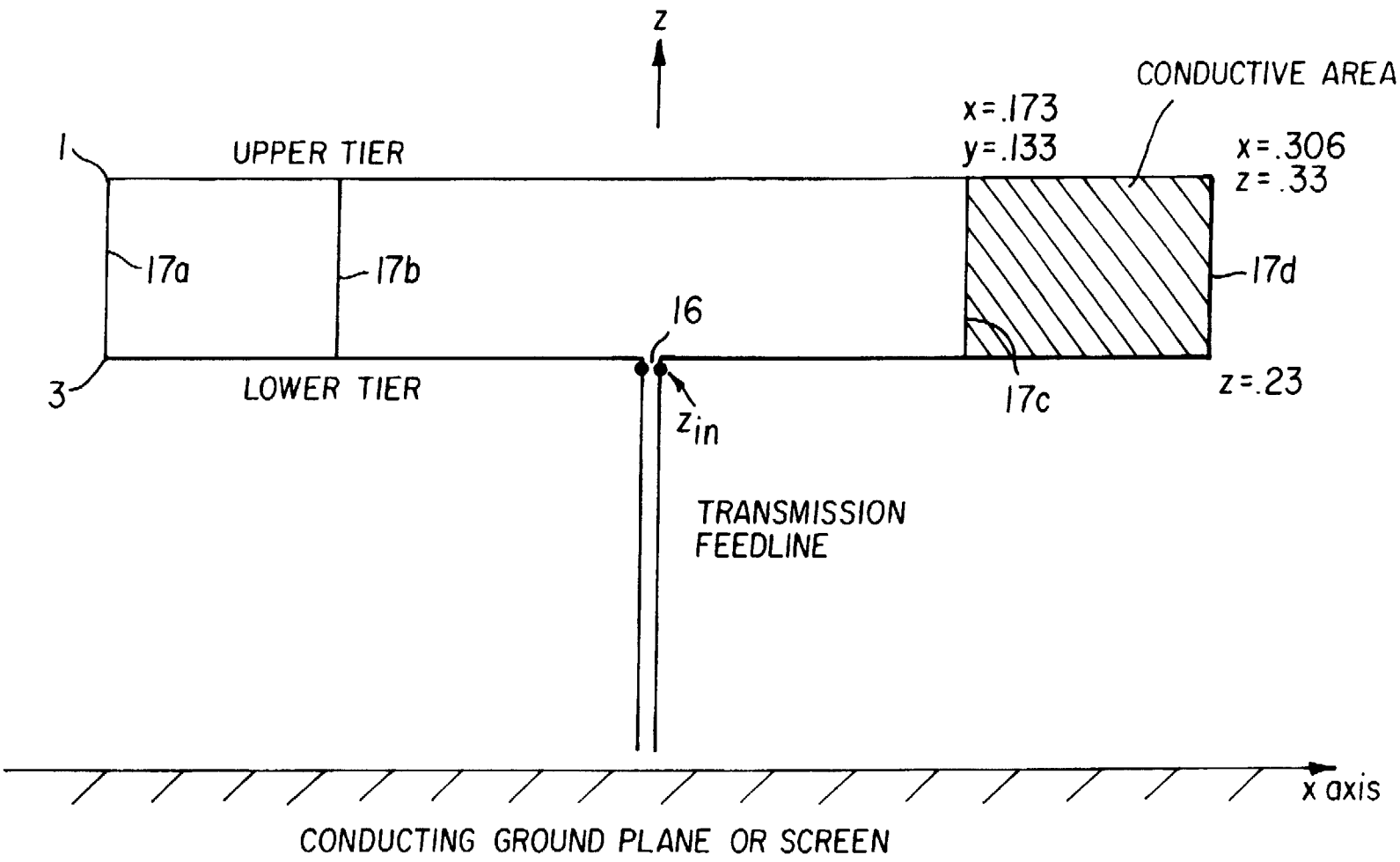
FIG. 3 is a side view of the first and second tiers illustrated in FIGS. 1 and 2.

Referring now to FIGS. 1–3, an antenna element 1 in accordance with a first embodiment of the invention, and generally of the type disclosed in U.S. Pat. No. 5,293,176, is shown as including two tiers comprising two crossed grid dipoles. Each crossed grid dipole lies upon a planar surface. The two tiers are separated vertically and lie one above the other, parallel to each other, and parallel to a ground plane. The first or upper tier is uppermost. The second or lower tier lies between the first tier and the ground plane. The tiers are separated by air or a non-conducting dielectric material. Each line illustrated in FIGS. 1 and 2 represents the location of a conductor, such as a wire or other conductive element, in the upper and lower tiers. FIG. 3 illustrates a side view of the two tier construction of the antenna element 1.

Each crossed dipole includes two grid dipoles. Each grid dipole includes two arms, typically quadrilateral arms. Each quadrilateral arm is formed from four perimeter or peripheral conductors and one axial conductor. The axial conductors of each arm are positioned along the axis of the dipole. As shown in FIGS. 1 and 2, in each tier one dipole axis is oriented parallel to the X axis and a second dipole axis is oriented parallel to the Y axis. The conductors may be identified as follows in FIGS. 1 and 2. On the upper tier, quadrilateral conducting grid arms 9*a* and 9*b* form one of the dipoles and quadrilateral arms 9*c* and 9*d* form the other one of the dipoles. All four arms 9*a*, 9*b*, 9*c* and 9*d* form the crossed dipole. Similarly, on the lower tier, conducting grid arms 11*a* and 11*b* form one of the dipoles and conducting grid arms 11*c* and 11*d* form the other one of the dipoles. The two dipoles on the upper tier have axial conductors 10*a*–10*b* or 10*c*–10*d*. The two dipoles on the lower tier have axial conductors 12*a*–12*b* or 12*c*–12*d*. The dipoles have additional conductors around a perimeter to produce the wide grid dipole shapes shown.

In the first or upper tier the conductor grid arm 9*a* forms a quadrilateral having four sides with its furthers perimeter or periphery corner 13*a* along its respective axis 10*a* at a distance from a common center 8 or interior corner. The remaining perimeter or periphery corners of quadrilateral arm 9*a* are shown at 14*a* and 15*a* and are located a distance away from the axis and from the common center 8. Similarly, the conductor grid arm 9*b* forms a quadrilateral having four sides with its furthest perimeter or periphery corner 13*b* along its respective axis 10*b* at a distance from a common center 8 or interior corner. Thus, the two quadrilateral arms 9*a* and 9*b* along the same axis 10*a*–10*b* form a dipole. The second dipole in FIG. 1 is formed from quadrilateral arms 9*c* and 9*d*, and has identical dimensions to dipole 9*a*–9*b* except that it lies along axis 10*c*–10*d*.

The lower tier illustrated in FIG. 2 has identical coordinates to the upper tier with two exceptions. First, the lower tier is located in a plane closer to the ground plane (lower Z coordinate) as shown in FIG. 3. Secondly, the lower tier is fed by a transmission line, so there is a small gap 15 between the quadrilateral arms on the lower tier to permit feeding from a balanced transmission line in the manner of a turnstile antenna. FIG. 2 illustrates these feed points. One dipole on the lower tier formed by quadrilateral grids 11*c* and 11*d* is fed between points a and a', and the second dipole formed by quadrilateral grids 11*a* and 11*b* on the lower tier is fed between points b and b'; a–a' is one balanced input and b–b' is a second balanced input. The two balanced inputs are fed in quadrature phase to transmit circular polarization from the antenna element. The dipoles on the upper tier are not fed. Instead, all twelve of the conductors converging at the center 8 are electrically connected together at the center 8 as shown in FIG. 1.

With the quadrilateral arms shown, the top and bottom tiers are preferably connected at twelve points on the periphery of the antenna element 1 by twelve vertical conductors 17*a*–17*d* located at each of the 12 perimeter corners (conductor junctions) on the periphery of the dipoles. Each quadrilateral arm is therefore connected at three points to the quadrilateral arm directly above or below it on the other tier.

FIG. 3 illustrates a side view of one dipole on each tier and the vertical connections between them. The axis of the second dipole on each tier is orthogonal or out of the page. FIG. 3 also illustrates that the vertical connection between the tiers provides some features of a folded dipole, since the upper tier forms the folded portion of the folded dipole. Further details of the basic construction, including preferred element lengths, can be found in U.S. Pat. No. 5,293,176.

The first embodiment of an improvement to the basic structure of the antenna element 1 includes filling in, either partially or completely, some or all of the area or areas defined by a group or groups of the perimeter conductors described above with conductive material. For example, as illustrated in FIG. 1, at least one area between a group of the perimeter conductor elements on the upper tier is either partially or completely metallized. In addition, as illustrated in FIG. 2, at least one area between a group of the perimeter conductors on the lower tier can be either partially or completely filled with a conductor. Still further, as indicated in FIG. 3, at least one area between a group of the conductor elements of the upper and lower tiers and the vertical conductors at an outward facing end of the antenna element is either partially or completely filled with a conductive material. Any combination of partially or completely filled areas between the upper and lower tiers and sides is possible. Further, any desired pattern of conductive material can be utilized in the partially conductive areas.

Figure 4:
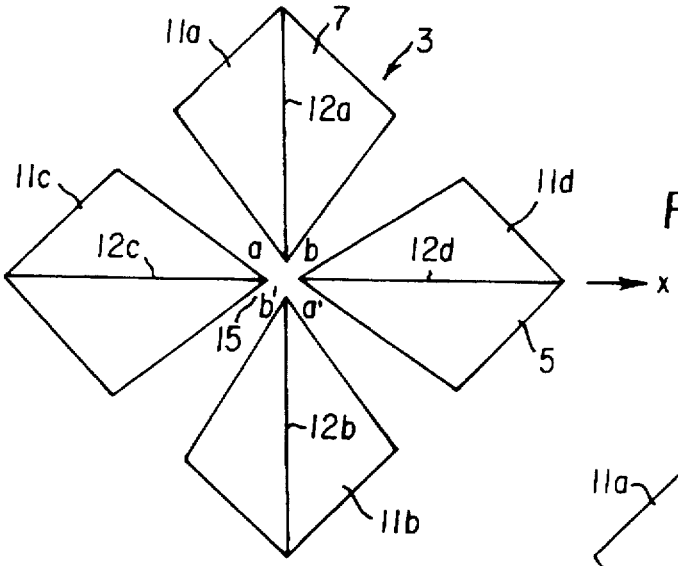
FIG. 4 is a top view of a first tier of an antenna element in accordance with a second embodiment of the invention.
Figure 5:
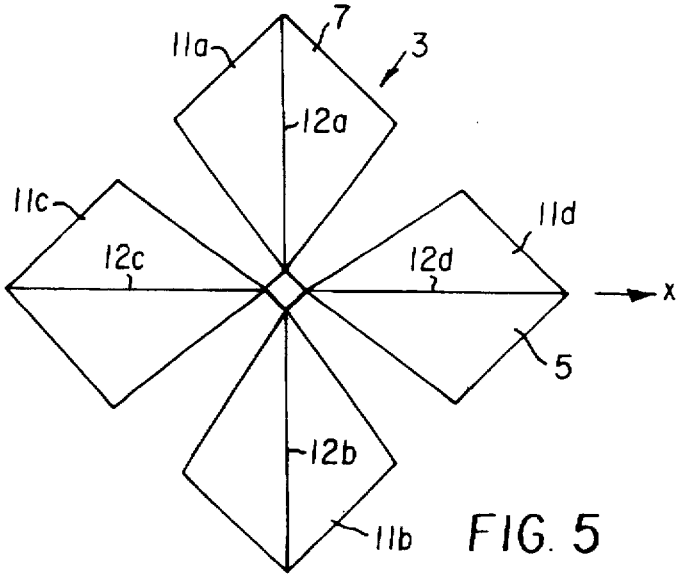
FIG. 5 is a top view of a second tier of an antenna element in accordance with a second embodiment of the invention.
Figure 6:
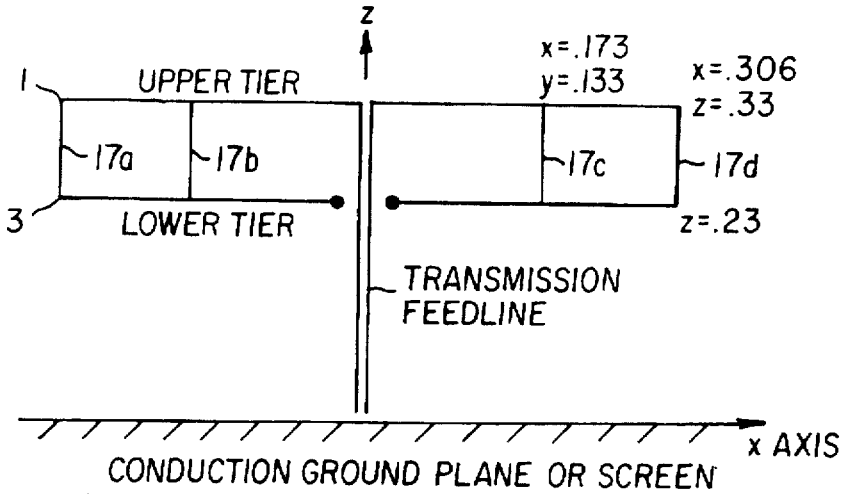
FIG. 6 is a side view of the first and second tiers illustrated in FIGS. 4 and 5.

In a second embodiment of an improvement to the basic structure of the antenna element, the upper and lower tiers of FIGS. 1 and 2 are reversed. In the second embodiment illustrated in FIGS. 4–6, the upper tier of FIG. 4 is the same as the lower tier of FIG. 2. The lower tier of FIG. 5 is substantially the same as the upper tier of FIG. 1, with the exception that the connection of the four arms at the center (for example a circular, square or polygonal connection) leaves an opening through which the transmission feed line can extend to the upper tier as shown in FIG. 6. The feeding of the antenna element from the upper tier instead of the bottom tier may be more economical in certain applications.

The invention has been described with reference to certain preferred embodiments thereof. It will be understood, however, that modifications and variations are possible within the scope of the appended claim. For example, the areas between conductors in the embodiment illustrated in FIGS. 4–6 can also be partially or complete filled with conductive material. Further, if an area is completely filled with a conductive material, for example a metallized layer, it will be understood that the edges of the conductive material can be defined as perimeter conductors for the purposes of this disclosure. Accordingly, a completely filled area is an area defined by a group of conductors for the purposes of interpreting the appended claims.

What is claimed is:

1. An antenna element comprising:

a ground plane;

a first crossed grid dipole including a plurality of perimeter conductors, said first crossed grid dipole being arranged in an X-Y plane corresponding to a first tier and including an interconnected plurality of arms; and a second crossed grid dipole including a plurality of perimeter conductors, said second crossed grid dipole being arranged in an X-Y plane corresponding to a second tier and including a plurality of non-interconnected arms, each of said non-interconnected arms including a feed input;

wherein said first tier is vertically separated from said second tier and said ground plane, and said second tier is located between said ground plane and said first tier;

wherein said first crossed grid dipole is connected to said second crossed grid dipole by vertical conductors; and wherein an area defined by at least one of a group of the perimeter conductors of the first crossed grid dipole, a group of the perimeter conductors of the second crossed grid dipole, and a group of the perimeter conductors of the first and second crossed gird dipoles and the vertical conductors, is at least partially conductive.

2. An antenna element as claimed in claim 1, wherein each arm of said first crossed dipole and said second crossed dipole includes a central axial conductor surrounded by said peripheral conductors.

3. An antenna element as claimed in claim 2, wherein said perimeter conductors of each arm are arranged to form a polygon having a plurality of sides joined at periphery corners and having one center corner.

4. An antenna element as claimed in claim 3, wherein said polygon is a quadrilateral with sides joined at four corners.

5. An antenna element as claimed in claim 4, wherein each of said arms on said first tier is connected to corresponding arms on said second tier at three of said four corners by said vertical conductors, said three corners being on a periphery of said arm, the fourth corner being a center corner not connected between the tiers and being located at a center of said first and second crossed grid dipole.

6. An antenna element as claimed in claim 5, wherein said center corners of said arms of said first tier are interconnected at a common point on said tier.

7. An antenna element as claimed in claim 1, further comprising transmission feeding means for feeding said second tier.

8. An antenna element as claimed in claim 1, wherein said first tier, said second tier and said ground plane are separated by air.

9. An antenna element as claimed in claim 1, wherein a distance separating one of said first tier, said second tier and said ground plane is filled with dielectric material.

10. An antenna element comprising:

a ground plane;

a first crossed grid dipole including a plurality of perimeter conductors, said first crossed grid dipole being arranged in an X-Y plane corresponding to a first tier and including a plurality of non-interconnected arms, each of said non-interconnected arms including a feed input;

a second crossed grid dipole including a plurality of perimeter conductors, said second crossed grid dipole being arranged in an X-Y plane corresponding to a second tier and including a plurality of interconnected arms;

wherein said first tier is vertically separated from said second tier and said ground plane, and said second tier is located between said ground plane and said first tier; and wherein said first crossed grid dipole is connected to said second crossed grid dipole by vertical conductors.

11. An antenna element as claimed in claim 10, wherein an area defined by at least one of a group of the perimeter conductors of the first crossed grid dipole, a group of the perimeter conductors of the second crossed grid dipole, and a group of the perimeter conductors of the first and second crossed grid dipoles and the vertical conductors, is at least partially conductive.

12. An antenna element as claimed in claim 10, wherein each arm of said first crossed dipole and said second crossed dipole includes a central axial conductor surrounded by said peripheral conductors.

13. An antenna element as claimed in claim 12, wherein said perimeter conductors of each arm are arranged to form a polygon having a plurality of sides joined at periphery corners and having one center corner.

14. An antenna element as claimed in claim 13, wherein said polygon is a quadrilateral with sides joined at four corners.

15. An antenna element as claimed in claim 14, wherein each of said arms on said first tier is connected to corresponding arms on said second tier at three of said four corners by said vertical conductors, said three corners being on a periphery of said arm, the fourth corner being a center corner not connected between the tiers and being located at a center of said first and second crossed grid dipole.

16. An antenna element as claimed in claim 15, wherein said center corners of said arms of said second tier are interconnected to permit a transmission feed line to pass through the second tier and to said feed inputs of the arms of said first crossed grid dipole.

17. An antenna element as claimed in claim 10, wherein said first tier, said second tier and said ground plane are separated by air.

18. An antenna element as claimed in claim 10, wherein a distance separating one of said first tier, said second tier and said ground plane is filled with dielectric material.

* * * * *